US006629750B2

(12) United States Patent
Ciordia

(10) Patent No.: US 6,629,750 B2
(45) Date of Patent: Oct. 7, 2003

(54) AEROGEL FOAM SPITTOON SYSTEM FOR INKJET PRINTING

(75) Inventor: Oscar Ciordia, Sant Cugat de Vallés (ES)

(73) Assignee: Hewlett Packard Development Company L.P., Houston, TX (US)

( * ) Notice: Subject to any disclaimer, the term of this patent is extended or adjusted under 35 U.S.C. 154(b) by 0 days.

(21) Appl. No.: 10/066,354

(22) Filed: Jan. 31, 2002

(65) Prior Publication Data

US 2003/0142166 A1 Jul. 31, 2003

(51) Int. Cl.[7] ..... B41J 2/165
(52) U.S. Cl. ..... 347/36; 516/98

(58) Field of Search ..... 347/36, 89, 90; 516/98; 34/302, 305

(56) References Cited

U.S. PATENT DOCUMENTS 4,901,094 A * 2/1990 Iwagami et al. ..... 347/36
5,157,421 A * 10/1992 Kitahara ..... 347/36

* cited by examiner

*Primary Examiner*—Huan Tran

(57) ABSTRACT

A spittoon system is provided for receiving ink residue spit from an inkjet printhead in an inkjet printing mechanism. The spittoon system includes a storage container having a chamber, and an aerogel foam within the chamber for absorbing the received ink residue.

26 Claims, 9 Drawing Sheets

AEROGEL FOAM SPITTOON SYSTEM FOR INKJET PRINTING

BACKGROUND OF THE INVENTION

The present invention relates generally to inkjet printing mechanisms, and more particularly to a spittoon system having a porous material for capturing waste inkjet ink spit from an inkjet printhead during a nozzle clearing, purging or spitting operation.

An inkjet printing mechanism is a type of non-impact printing device which forms characters, symbols, graphics or other images by controllably spraying drops of ink. The mechanism typically includes a cartridge, often called a "pen," which houses a printhead. The printhead has very small nozzles through which the ink drops are ejected. To print an image the pen is propelled back and forth across a media sheet, while the ink drops are ejected from the printhead in a controlled pattern.

Inkjet printing mechanisms may be employed in a variety of devices, such as printers, plotters, scanners, facsimile machines, copiers, and the like. There are various forms of inkjet printheads, known to those skilled in the art, including, for example, thermal inkjet printheads and piezoelectric printheads. Two earlier thermal inkjet ejection mechanisms are shown in U.S. Pat. Nos. 5,278,584 and 4,683,481, currently assigned to the present assignee, The Hewlett-Packard Company of Palo Alto, Calif. In a thermal inkjet printing system, ink flows along ink channels from a reservoir into an array of vaporization chambers. Associated with each chamber is a heating element and a nozzle. A respective heating element is energized to heat ink contained within the corresponding chamber. The corresponding nozzle forms an ejection outlet for the heated ink. As the pen moves across the media sheet, the heating elements are selectively energized causing ink drops to be expelled in a controlled pattern. The ink drops dry on the media sheet shortly after deposition to form a desired image (e.g., text, chart, graphic or other image).

It is desirable to clean and protect the printhead, so that ink does not dry on the printhead surface or clog the nozzles. Typically, a service station mechanism is included to perform such maintenance of the printhead. For storage, or during non-printing periods, the pen moves to the service station. The service station often includes a capping device which substantially seals the printhead nozzles to prevent drying and to avoid entry of contaminants. Some capping devices also facilitate a priming operation. For example a pumping unit is connected to the capping device applying a vacuum force onto the printhead. The force pulls the ink through the printheads channels and vaporization chamber-s:and is referred to as ink priming. Priming is desirable so the vaporization chambers are filled when printing is desired. Depriming, where the ink is sucked back along the channels into the ink reservoir, is undesirable.

Another maintenance operation is referred to as "spitting." During a spitting operation, a number of "waste" ink drops are spit from each nozzle into a "spittoon" reservoir portion of the service station. The spitting is performed periodically to clear the nozzles and avoid clogging.

Still another maintenance operation is referred to as "wiping." During a wiping operation, an elastomeric wiper wipes the printhead surface to remove ink residue, as well as paper, dust or other debris that has collected on the printhead. The wiping action is achieved through the relative motion of the printhead and wiper for example, by moving the printhead across the wiper, by moving the wiper across the printhead, or by moving both the printhead and the wiper. A wiping operation typically is performed after spitting, after uncapping, and occasionally interspersed among a print job.

As the inkjet industry investigates new printhead designs, the tendency is toward using permanent or semi-permanent printheads in what is known in the industry as an "off-axis" system. In an off-axis system only a small ink supply is carried across the printzone, with this supply being replenished through tubing that delivers ink from an off-axis stationary reservoir placed at a remote stationary location within the inkjet system. As a result, narrower printheads are achieved allowing for a narrower printing mechanism and a narrower system "footprint." Also, associated with the narrower printhead are a smaller, lighter carriage and bearings. In turn a smaller or lighter drive motor is implemented leading to a more economical system for the consumer.

To improve the clarity and contrast of the printed image, advances are being sought for improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies, fabric and other media. However, the combination of small nozzles and quick-drying ink leaves the printheads susceptible to clogging, not only from dried ink or minute dust particles, such as paper fibers, but also from the solids within the new inks themselves. Accordingly, frequent spitting operations are performed before, during and after a print job.

Other challenges from the new inks include "stalagmite-type" buildups of the ink in the spittoon and increased aerosol exposure. When spitting the new pigment-based inks onto the flat bottom of a conventional spittoon, over a period of time, the rapidly solidifying waste ink grows into a stalagmite of ink residue. Eventually, in prototype units, the ink residue would grow to contact the printhead, which then either interfered with printhead movement, hindered print quality, or clogged inkjet nozzles.

The frequent spitting operations performed when using the pigment-based inks also results in an aerosol of small minute ink particles which become detached from the main ink droplet and begin floating through the system. The aerosol is carried by air currents landing at undesirable locations. Often the aerosol landed on critical components resulting in fogging of the optical encoder, or in fouling portions of the casing and carriage where an operator would touch when installing a new pen. Sometimes the aerosol enters the media path and is picked up by the next media sheet, leading to print quality defects.

SUMMARY OF THE INVENTION

According to one aspect of the present invention, a spittoon system is provided for receiving ink residue spit from an inkjet printhead in an inkjet printing mechanism. The spittoon system includes a storage container having a chamber, and an aerogel foam within the chamber for absorbing the received ink residue.

DETAILED DESCRIPTION OF A PREFERRED EMBODIMENT

Figure 1:
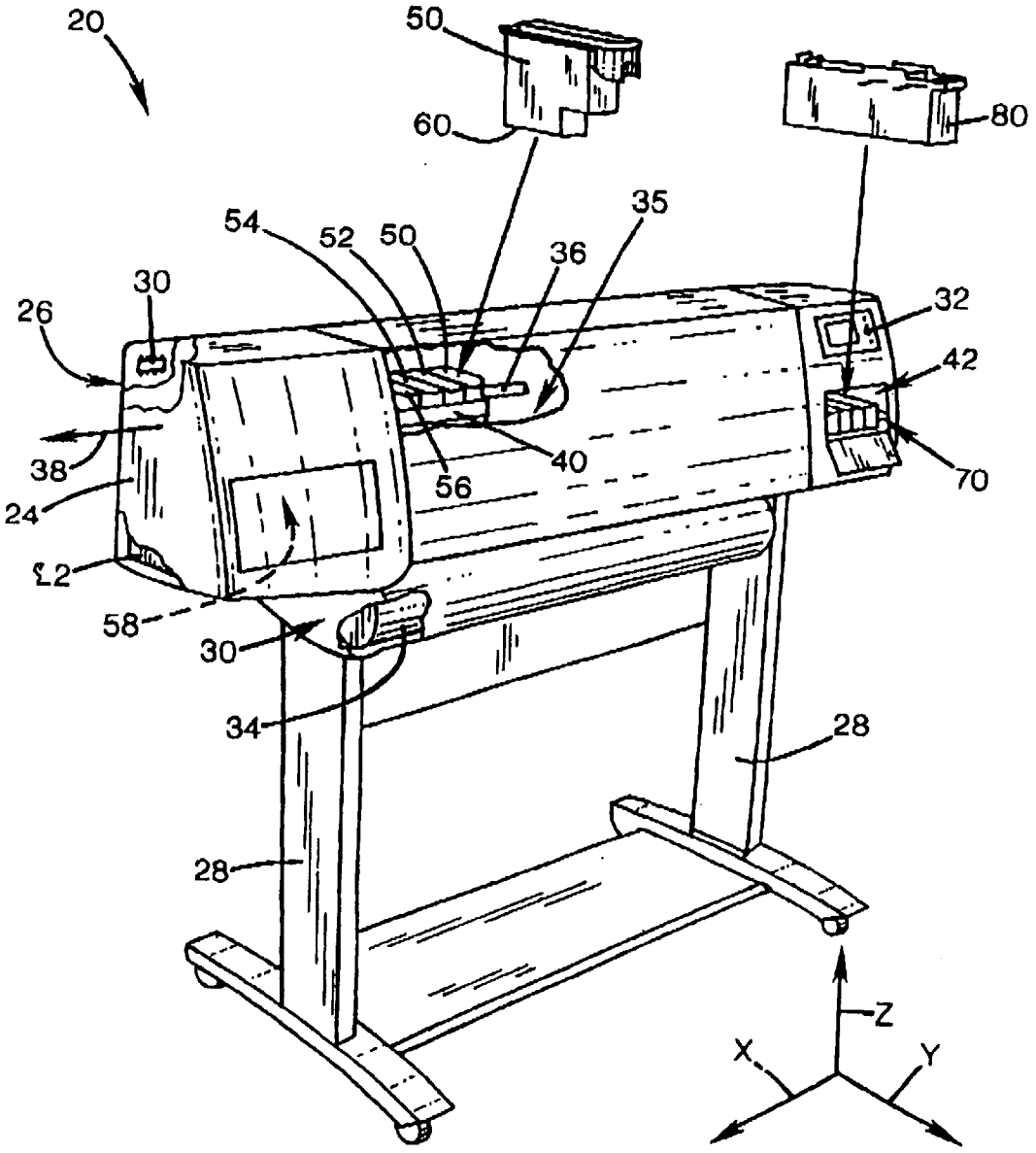
FIG. 1 is a perspective view of one form of an inkjet printing mechanism, here an inkjet plotter, including one form of an inkjet printhead cleaner service station system, shown here to service a set of off-axis inkjet printheads.

FIG. 1 illustrates an embodiment of an inkjet printing mechanism, here shown as an inkjet plotter 20, constructed in accordance with the present invention, which may be used for printing conventional engineering and architectural drawings, as well as high quality poster-sized images, and the like, in an industrial, office, home or other environment. A variety of inkjet printing mechanisms are commercially available. For instance, some of the printing mechanisms that may embody the present invention include desk top printers, portable printing units, copiers, cameras, video printers, and facsimile machines, to name a few. For convenience the concepts of the present invention are illustrated in the environment of an inkjet plotter 20.

While it is apparent that the plotter components may vary from model to model, the typical inkjet plotter 20 includes a chassis 22 surrounded by a housing or casing enclosure 24, typically of a plastic material, together forming a print assembly portion 26 of the plotter 20. While it is apparent that the print assembly portion 26 may be supported by a desk or tabletop, it is preferred to support the print assembly portion 26 with a pair of leg assemblies 28. The plotter 20 also has a plotter controller, illustrated schematically as a microprocessor 30, that receives instructions from a host device, typically a computer, such as a personal computer or a computer aided drafting (CAD) computer system (not shown). The plotter controller 30 may also operate in response to user inputs provided through a key pad and status display portion 32, located on the exterior of the casing 24. A monitor coupled to the computer host may also be used to display visual information to an operator, such as the plotter status or a particular program being run on the host computer. Personal and drafting computers, their input devices, such as a keyboard and/or a mouse device, and monitors are all well known to those skilled in the art.

A conventional print media handling system (not shown) may be used to advance a continuous sheet of print media 34 from a roll through a printzone 35. The print media may be any type of suitable sheet material, such as paper, poster board, fabric, transparencies, mylar, and the like, but for convenience, the illustrated embodiment is described using paper as the print medium. A carriage guide rod 36 is mounted to the chassis 22 to define a scanning axis 38, with the guide rod 36 slideably supporting an inkjet carriage 40 for travel back and forth, reciprocally, across the printzone 35. A conventional carriage drive motor (not shown) may be used to propel the carriage 40 in response to a control signal received from the controller 30. To provide carriage positional feedback information to controller 33, a conventional metallic encoder strip (not shown) may be extended along the length of the printzone 35 and over the servicing region 42. A conventional optical encoder reader may be mounted on the back surface of printhead carriage 40 to read positional information provided by the encoder strip, for example, as described in U.S. Pat. No. 5,276,970, also assigned to Hewlett-Packard Company, the assignee of the present invention. The manner of providing positional feedback information via the encoder strip reader, may also be accomplished in a variety of ways known to those skilled in the art. Upon completion of printing an image, the carriage 40 may be used to drag a cutting mechanism across the final trailing portion of the media to sever the image from the remainder of the roll 34. Suitable cutter mechanisms are commercially available in DesignJet.RTM. 650 C. and 750 C. color plotters, produced by Hewlett-Packard Company, of Palo Alto, Calif., the present assignee. Of course, sheet severing may be accomplished in a variety of other ways known to those skilled in the art. Moreover, the illustrated inkjet printing mechanism may also be used for printing images on pre-cut sheets, rather than on media supplied in roll 34.

Figure 2:
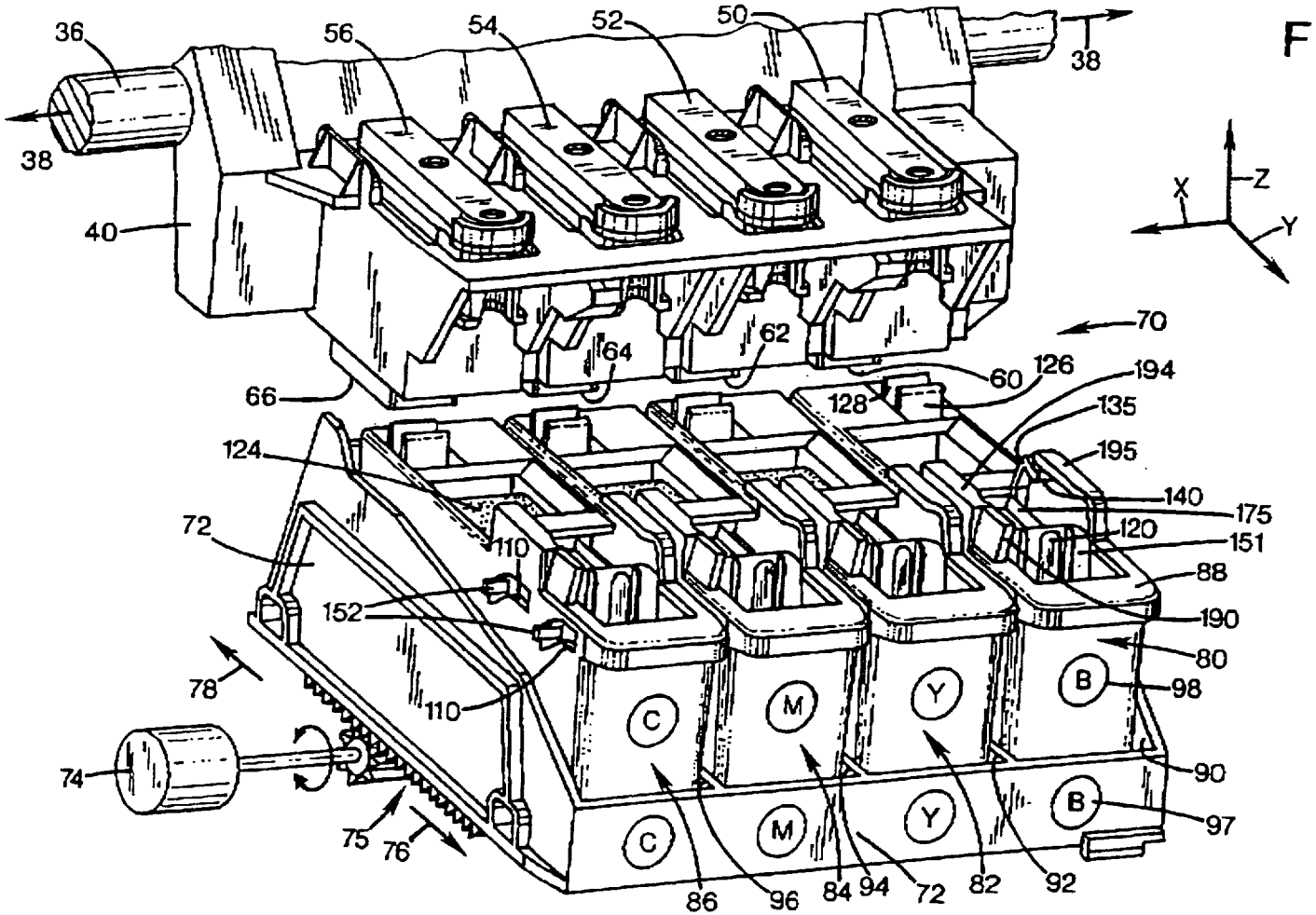
FIG. 2 is an enlarged perspective view of the service station system shown prior to servicing the wide swath printheads of FIG. 1.

In the printzone 35, the media sheet receives ink from an inkjet cartridge, such as a black ink cartridge 50 and three monochrome color ink cartridges 52, 54 and 56, shown in greater detail in FIG. 2. The cartridges 50–56 are also often calls "pens" by those in the art. The black ink pen 50 is illustrated herein as containing pigment-based ink. For the purposes of illustration, color pens 52, 54 and 56 are described as each containing a dye-based ink of the colors yellow, magenta and cyan, respectively, although it is apparent that the color pens 52–56 may also contain pigment-based inks in some implementations. It is apparent that other types of ink may also be used in the pens 50–56, such as paraffin-based inks, as well as hybrid composite inks having both dye and pigment characteristics. The illustrated plotter 20 uses an "off-axis" ink delivery system, having main stationary reservoirs (not shown) for each ink (black, cyan, magenta, yellow) located in an ink supply region 58. In this off-axis system, the pens 50–56 may be replenished by ink conveyed through a conventional flexible tubing system (not shown) from the stationary main reservoirs, so only a small ink supply is propelled by carriage 40 across the printzone 35 which is located "off-axis" from the path of printhead travel. As used herein, the term "pen" or "cartridge" may also refer to replaceable printhead cartridges where each pen has a reservoir that carries the entire ink supply as the printhead reciprocates over the printzone. The illustrated pens 50, 52, 54 and 56 have printheads 60, 62, 64 and 66, respectively, which selectively eject ink to form an image on a sheet of media 34 in the printzone 35. The concepts disclosed herein for cleaning the printheads 60–66 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 60, 62, 64 and 66 each have an orifice plate with a plurality of nozzles formed therethrough in a manner well known to those skilled in the art. The nozzles of each printhead 60–66 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 38, with the length of each array determining the maximum image swath for a single pass of the printhead. The illustrated printheads 60–66 are thermal inkjet printheads, although other types of printheads may be used, such as piezoelectric printheads. The thermal printheads 60–66 typically include a plurality of resistors which are associated with the nozzles. Upon energizing a selected resistor, a bubble of gas is formed which ejects a droplet of ink from the nozzle and onto a sheet of paper in the printzone 35 under the nozzle. The printhead resistors are selectively energized in response to firing command control signals delivered from the controller 30 to the printhead carriage 40.

Service Station System

FIG. 2 shows the carriage 40 positioned with the pens 50–56 ready to be serviced by a printhead cleaner service station system 70. The service station 70 includes a translationally moveable pallet 72, which is selectively driven by motor 74 through, rack and pinion gear assembly 75 in a forward direction 76 and in a rearward direction 78 in response to a drive signal received from the controller 30. The service station 70 includes four replaceable inkjet printhead cleaner units 80, 82, 84 and 86, constructed in accordance with the present invention for servicing the respective printheads 50, 52, 54 and 56. Each of the cleaner units 80–86 include an installation and removal handle 88, which may be gripped by an operator when installing the cleaner units 80–86 in their respective chambers or stalls 90, 92, 94, and the 96 defined by the service station pallet 72. Following removal, the cleaning units 80–86 are typically disposed of and replaced with a fresh unit, so the units 80–86 may also be referred to as "disposable cleaning units," although it may be preferable to return the spent units to a recycling center for refurbishing. To aid an operator in installing the correct cleaner unit 80–86 in the associated stall 90–96, the pallet 72 may include indicia, such as a "B" marking 97 corresponding to the black pen 50, with the black printhead cleaner unit 80 including other indicia, such as a "B" marking 98, which may be matched with marking 97 by an operator to assure proper installation.

Figure 3:
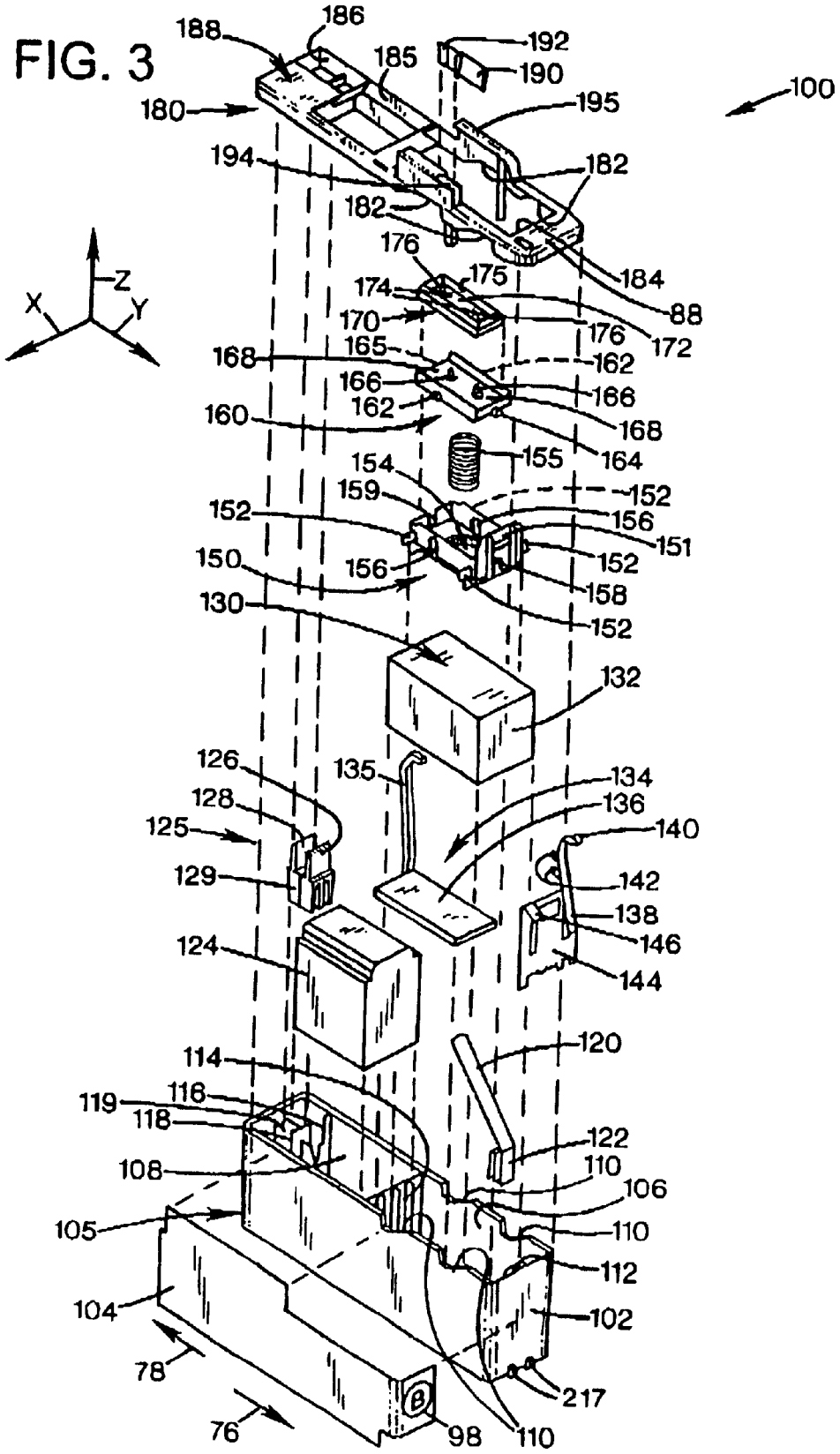
FIG. 3 is an enlarged exploded perspective view of a replaceable inkjet printhead cleaner unit of the service station system of FIG. 1, including one form of an aerogel foam spittoon embodiment of this invention.

FIG. 3 illustrates a generic cleaner unit assembly 100, including components for assembling both the black printhead cleaner unit 80 and the color cleaner units 82–86. Beginning near the bottom of the figure, and working upward, the generic cleaner unit 100 includes a base 102, to which a label 104 carrying indicia, such as the "B" marking 98 for the black cleaner unit 80, which may affixed to the exterior of base 102. Furthermore, to assure that the cleaner units 80–86 cannot be physically inserted in the wrong pallet stall 90–96, a series of mounting tabs unique for each of the cleaner units 80–86 may be molded along a rear comer 105 of the base 102, with mating slots being supplied within the rear portion of the stalls 90–96 of the pallet 72. The base 102 defines two reservoir chambers, including an ink solvent chamber 106 and a spittoon chamber 108. Other features of the base 102 include four cam surfaces or cap ramps 110, which are used during the printhead capping and uncapping process as described further below. The base 102 also defines several different mounting locations for other components of the cleaner unit 100, including a cap return spring mounting wall 112, a solvent applicator spring mounting wall 114, a black wiper mounting wall 116, a color wiper mounting wall 118, with a brace wall 119 extending between the black and color wiper mounting walls 116 and 118.

The generic cleaning unit assembly unit 100 also includes a cap sled return spring 120, which includes a mounting lip 122 received by the cap spring mounting wall 112 of base 102. For the color cleaner units 82–86 the spittoon 108 is filled with an ink absorber, such as a porous aerogel foam 124 having a large surface area, a low density, and a rigid, stable outer shape and a rigid, stable inner network. The aerogel foam 124 receives ink spit from the color printheads 62–66, and then holds this ink while the volatiles or liquid components evaporate, leaving the solid components of the ink trapped within the networked chambers of the aerogel material. In some embodiments the spittoon 108 of the black cleaner unit 80 omits the foam, and is supplied as an empty chamber, which then fills with the tar-like black ink residue over the life of the cleaner unit. Further description of the aerogel foam 124 is provided below in a separate section.

A dual bladed wiper assembly 125 has two wiper blades 126 and 128, which are preferably constructed with rounded exterior wiping edges, and an angular interior wiping edge, as described in the Hewlett-Packard Company's U.S. Pat. No. 5,614,930. The wiper assembly 125 includes abase portion 129 which resiliently grips the black wiper mounting wall 116 when assembling the black cleaner unit 80. When assembling the color cleaner units 82–86, the wiper base 129 is installed on the color wiper mounting wall 118. Preferably, each of the wiper assemblies 125 is constructed of a flexible, resilient, non-abrasive, elastomeric material, such as nitrile rubber, or more preferably, ethylene polypropylene diene monomer (EPDM), or other comparable materials known in the art. For wipers 125, a suitable durometer, that is, the relative hardness of the elastomer, may be selected from the range of 35–80 on the Shore A scale, or more preferably within the range of 60–80, or even more preferably at a durometer of 70+/−5, which is a standard manufacturing tolerance.

For assembling the black cleaner unit 80, which is used to service the pigment based ink within the black pen 50, the ink solvent chamber 106 receives an ink solvent 130, which is held within a porous solvent reservoir body or block 132 installed within chamber 106. Preferably, the reservoir block 132 is made of a porous material, for instance, an open-cell thermoset plastic such as a polyurethane foam, a sintered polyethylene, or other functionally similar materials known to those skilled in the art. The inkjet ink solvent 130 is preferably a hygroscopic material that absorbs water out of the air, because water is a good solvent for the illustrated inks. Suitable hygroscopic solvent materials include polyethylene glycol ("PEG"), lipponic-ethylene glycol ("LEG"), diethylene glycol ("DEG"), glycerin or other materials known to those skilled in the art as having similar properties.

These hygroscopic materials are liquid or gelatinous compounds that will not readily dry out during extended periods of time because they have an almost zero vapor pressure. For the purposes of illustration, the reservoir block 132 is soaked with one preferred ink solvent, PEG.

To deliver the solvent 130 from the reservoir 132, the black cleaner unit 80 includes a solvent applicator or distribution member 134, which includes an applicator wick 135 and a base 136, which underlies the reservoir block 132. To hold the applicator wick 135 in place, the black cleaner unit 80 includes a wick spring 138 which terminates at a lip 140 that receives the distal end of the applicator wick 135. To further support the wick 135, the wick spring also includes two pairs of support tabs 142. The wick spring 138 has a mounting tab 144 which is supported by the spring mounting 114 of base 102. Another feature of the wick spring 138, is a reservoir securing tab 146, which rests over an upper service surface of the solvent reservoir block 132 to hold it in place within the solvent chamber 106 of base 102.

The generic cleaning unit assembly 100 also includes a cap sled 150 which has an activation wall 151 with a rear surface pushed by the printhead into a capping position and a front surface used to move the sled back into a rest position.

The cap sled 150 has four cam followers 152 which ride along the cap ramps or cams 110 of base 102. The interior of the cap sled 150 defines a spring receiving chamber 154, which receives a compression spring 155. The cap sled 150 defines a pair of laterally opposing slots 156, and a pair of longitudinally opposing slots 158 and 159, with slots 156 and 158 being enclosed slots, and the slot 159 having an open upper end to aid in assembly of the cleaner unit.

The generic cleaning unit 100 also includes a cap retainer member 160 which includes a pair of laterally opposing pins or posts 162 which are captured within the pair of slots 156 of the cap sled 150. The cap retainer 160 also includes two longitudinally opposing pins or posts 164 and 165, which are received within the respective slots 158 and 159 of the cap sled 150. Use of the posts 162, 164 and 165 in conjunction with the slots 156, 158 and 159 and the spring 155, allow the cap retainer to be gimbal-mounted to the cap sled 150, allowing the retainer 160 to move in the Z axis direction, while also being able to tilt between the X and Y axes, which aids in sealing the printheads 60–66. The cap retainer 160 also includes a pair of cap lip mounting posts or flanges 166. The retainer 160 also has an upper surface 168, which may define a series of channels or troughs, to act as a vent path to prevent depriming the printheads 60–66 upon sealing.

Overlying the cap retainer 160 is a cap lip member 170, which may be constructed of the same material used for the wiper assemblies 125. The cap lip member 170 has a base portion 172 which defines a pair of mounting holes 174 therethrough which are slip-fit or press-fit over the retainer flanges 166. Each retainer flange 166 has a trunk which terminates in a head having a diameter greater than the diameter of the trunk. The length of each flange trunk is selected to be approximately equal to the thickness of the cap lip base portion 172, so only the heads of flanges 166 extend above the base portion 172. To insure a lasting fit, the cap retainer post 166 may be swaged over. The elastomeric material of the lip member 170 allows the material surrounding the mounting holes 174 to resiliently grip the trunk portion of the flanges 166 to hold the lip assembly 170 against the retainer 160. Extending upward from the lip base 172 is a lip member 175 which is sized to extend around the nozzles of the printheads 60–66 when making contact therewith during a capping step described further below. To prevent depriming the nozzles of printheads 60–66 during capping, the lip base 172 has a pair of vent holes 176 extending therethrough which aid to relieve pressure along both ends of a sealing chamber formed by the lip base 172, the lip 175 and the lower surface of the orifice plates of printheads 60–66 when capping. The vents 176 allow air to escape from this sealing chamber along the labyrinth vent path defined by surface 168 of the cap retainer 160 to prevent depriming the printhead during a capping operation.

The generic assembly 100 also includes a cover 180. The cover 180 defines four upper ramps or cam surfaces 182 which cooperate with the cap ramps 110 of base unit 102 to clamp the cam followers 152 of the cap sled 150 therebetween for motion between uncapped and capped positions. The cover 180 also defines a cap opening 184, through which the lip member 170 moves to seal the printheads 60–66. The cover 180 also defines a spittoon opening or mouth 185, through which ink spit is delivered to the color spittoon aerogel foam 124 for the color cleaner units 82–86, or to the interior of the open spittoon 108 for the black cleaner unit 80. The cover 180 also defines a black wiper opening 186, through which extends the wiper assembly 125 when mounted on the black wiper mounting wall 116 of base 102. It is apparent that the cover 180 may be easily modified to put a color wiper opening at location 188, so the wiper assembly 125 may extend therethrough when mounted to the color wiper wall 118 of base 102, as shown in FIG. 6.

The generic cleaner assembly 100 also includes a snout wiper 190 for cleaning a rearwardly facing vertical wall portion of the printheads 60–66, which leads up to an electrical interconnect portion of pens 50–56. The snout wiper 190 includes a base portion 192 which is received within a snout wiper mounting groove 194 defined by cover 180. While the snout wiper 190 may have combined rounded and angular wiping edges as described above for wiper blades 126 and 128, blunt rectangular wiping edges are preferred since there is no need for the snout wiper to extract ink from the nozzles. The base cover 180 also includes a solvent applicator hood 195, which shields the extreme end of the solvent applicator wick 135 and the lip portion 140 of the wick spring 138 when assembled.

Figure 4:
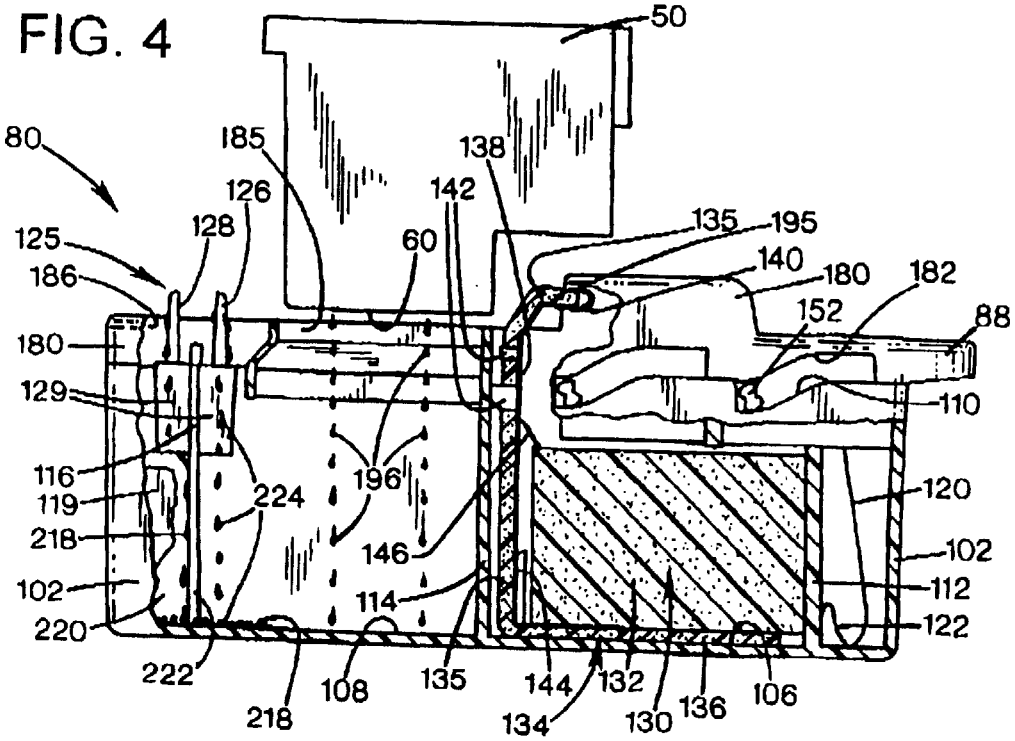
FIG. 4 is an enlarged, fragmented, side elevational view of a black printhead cleaner unit of the service station system of FIG. 1 showing a spittoon portion thereof ready to receive ink spit from a black printhead.
Figure 5:
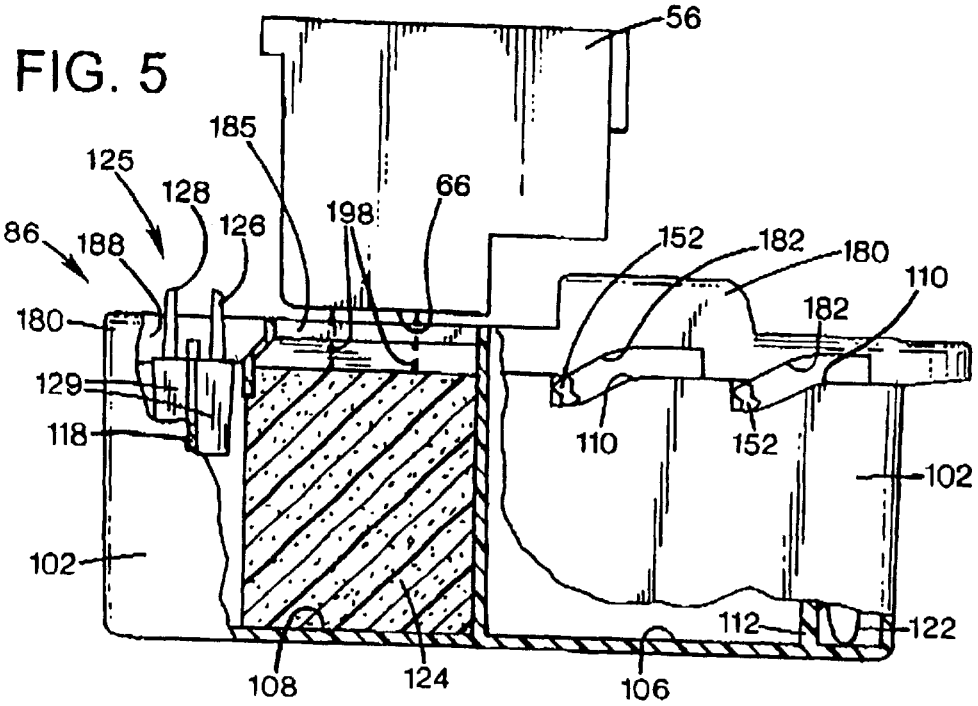
FIG. 5 is an enlarged, fragmented, side elevational view of a color printhead cleaner unit of the service station system of FIG. 1, shown with a spittoon portion thereof ready to receive ink spit from an associated color printhead of the printing mechanism.

FIGS. 4 and 5 illustrate the process of spitting to clear the printhead nozzles of any occlusions or blockages, with FIG. 4 showing the black pen 50 spitting ink droplets 196 into the bottom of spittoon 108, and FIG. 5 showing one of the color pens 56 spitting color ink droplets 198 onto the aerogel foam 124. As mentioned briefly above, the spittoon 108 of the black printhead cleaner 80 has no absorber, allowing the viscous black ink residue 218 to accumulate along the bottom of the reservoir floor. The color ink 198 is absorbed into the aerogel foam 124, which collects the solids while allowing the volatiles within the color ink 198 to evaporate. The black pigment based ink 196 does not dry as rapidly as the color ink, and forms a sticky tar-like residue, which is advantageously collected within the base of the spittoon 108 of the black printhead cleaner 80.

Figure 6:
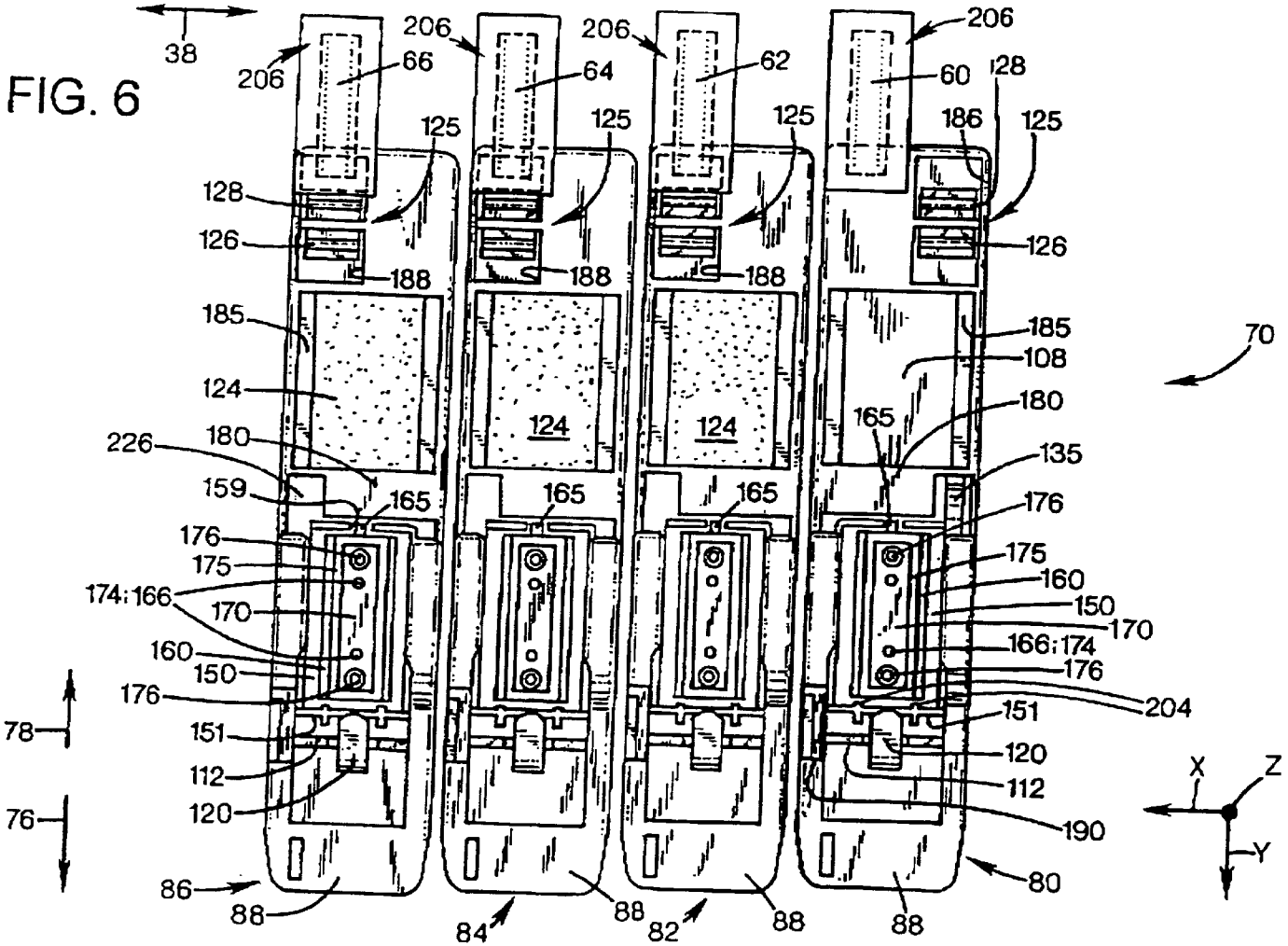
FIG. 6 is an enlarged top plan view of the replaceable service station system of FIG. 1 shown ready to begin wiping the color printheads.

FIG. 6 illustrates the position of the wiper assemblies 125 of the color cleaner units 82–86, just prior to the start of a wiping stroke where the pallet 72 (omitted for clarity from FIG. 6) moves the cleaner units in the rearward direction 78. To wipe the black printhead 60 with the wiper assembly 125 of the black cleaner the carriage 40 is moved to the right in the view of FIG. 6, along the scanning axis 38 to align the black wipers with the black printhead. Offsetting the wipers of the color printhead cleaners 82–86 from the wiping location of the black printhead cleaner 80, advantageously allows for different wiping schemes to be employed for cleaning the color printheads 62–66 than from the methods used to clean the black printhead 60. While wiping both the color and black pens at the same speed is preferred in the illustrated embodiment, the ability to employ individual wiping schemes is particularly advantageous when using different types of ink for color and black printing.

For example, in some implementations it is advantageous to use a slower wiping speed for the black pigment based ink, which is less viscous than the color dye based inks. Too slow of a wiping stroke wicks excessive amounts of ink from the dye based color inkjet pens 52–56. This excess dye based ink eventually builds-up a residue on the wiper, leading to less effective wiping in the future, as well as other problems. Actually, a scrubbing type of wiping routine is preferred to clean the tar-like pigment ink residue from the black printhead 60. If simultaneous wiping of all of the printheads was required, with a faster wipe used to accommodate the dye based inks, the wiper for the pigment based ink would be prevented from making full contact with the ink residue. Instead, the wiper would skip over bumps formed from the tar-like pigment based ink residue in a jerking or stuttering type of motion, which would fail to remove the residue from the printhead. Offsetting the color wipers from the wiping location of the black wiper allows the service station 70 to separately tailor the wiping schemes used to clean the color printheads 62–66 than from those used to clean the black printhead 60.

Figure 7:
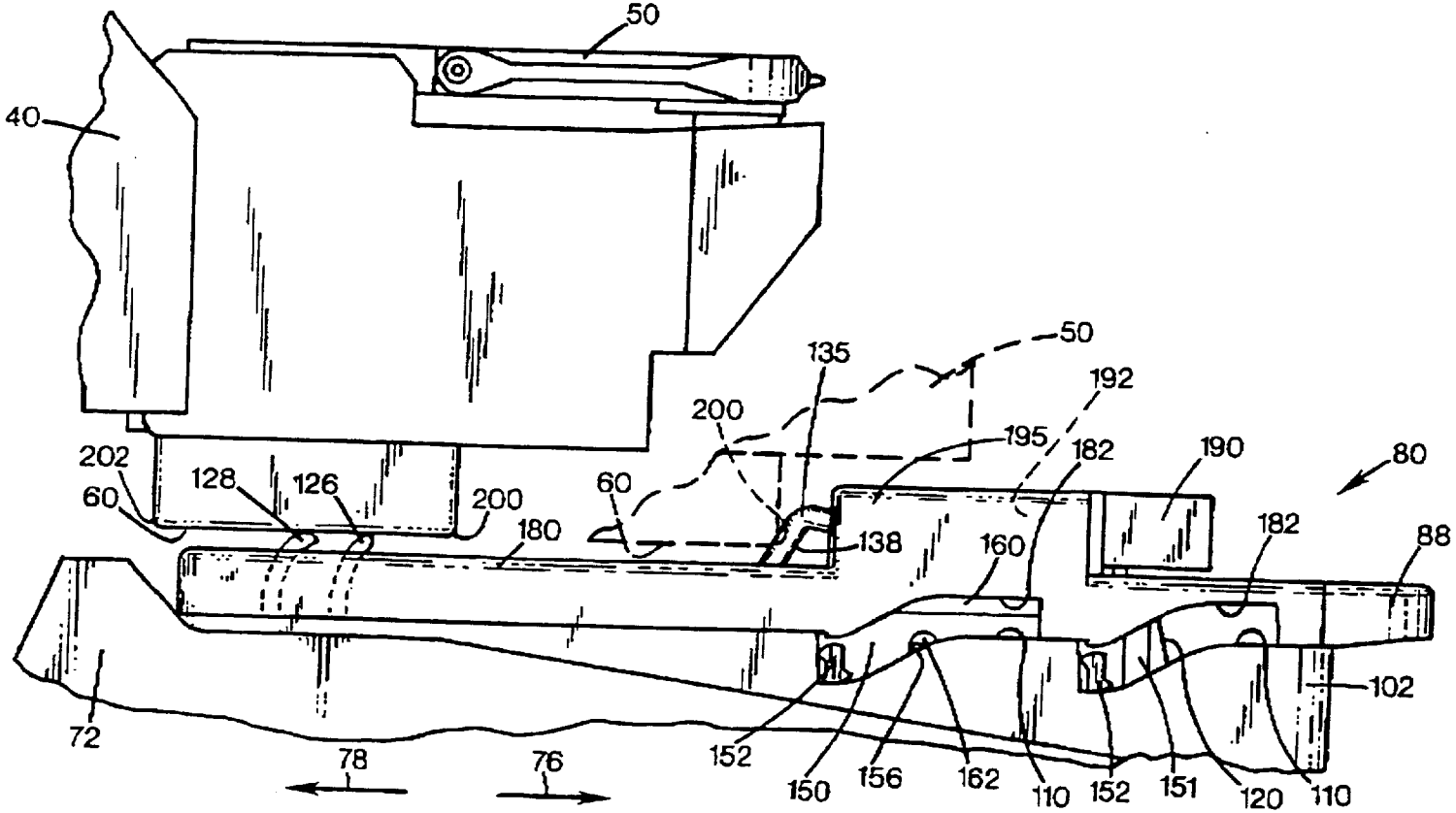
FIG. 7 is an enlarged side elevational view showing the black printhead cleaner unit of FIG. 1 wiping the black printhead in solid lines, and showing in dashed lines an applicator thereof applying an ink solvent to the black printhead.

FIG. 7 also illustrates application of the ink solvent 130, here a polyethylene glycol ("PEG") 300 treatment fluid, to a front edge 200 of printhead 60. Referring back to FIG. 4, the solvent reservoir block 132 is preferably constructed of a bonded nylon material, with the applicator member 134 being constructed of an open cell polyurethane foam, and the backing spring 140 being constructed of a sheet metal material. The solvent mainly serves to dissolve ink residue on the surface of the printhead, but also provides a secondary function of acting as a lubricant during the wiping strokes. PEG 300 is one preferred treatment fluid that assists the wiper in maintaining good nozzle health and orifice plate cleanliness throughout the life of the printhead.

As the leading edge 200 of the printhead 60 contacts the applicator 135, as shown in dashed lines in FIG. 7, fluid 130 is dispensed as the applicator wick 135 compressed by the printhead. When the foam of the applicator wick 135 is compressed, the solvent 130 is pushed out of the cells of the foam and onto the printhead leading edge 200. The wick spring 138 is preferably formed with a preload, which provides a resistant force to support the foam of wick 135 when pushed against by the printhead 60. The fluid 130 is then distributed over the orifice plate by the wipers 126, 128 during a subsequent wiping stroke. Thus, each successive dispensing of the ink solvent 130 adds to an existing quantity of solvent already resident on the printhead 60 and wipers 126, 128 from previous applications. The wiping stroke for the color and black cleaning assembly units 100, and the ink solvent dispensing system for the black cleaning assembly unit are further described in U.S. Pat. No. 6,224,186 issued May 1, 2001, and currently assigned to the present assignee, the Hewlett-Packard Company.

Figure 8:
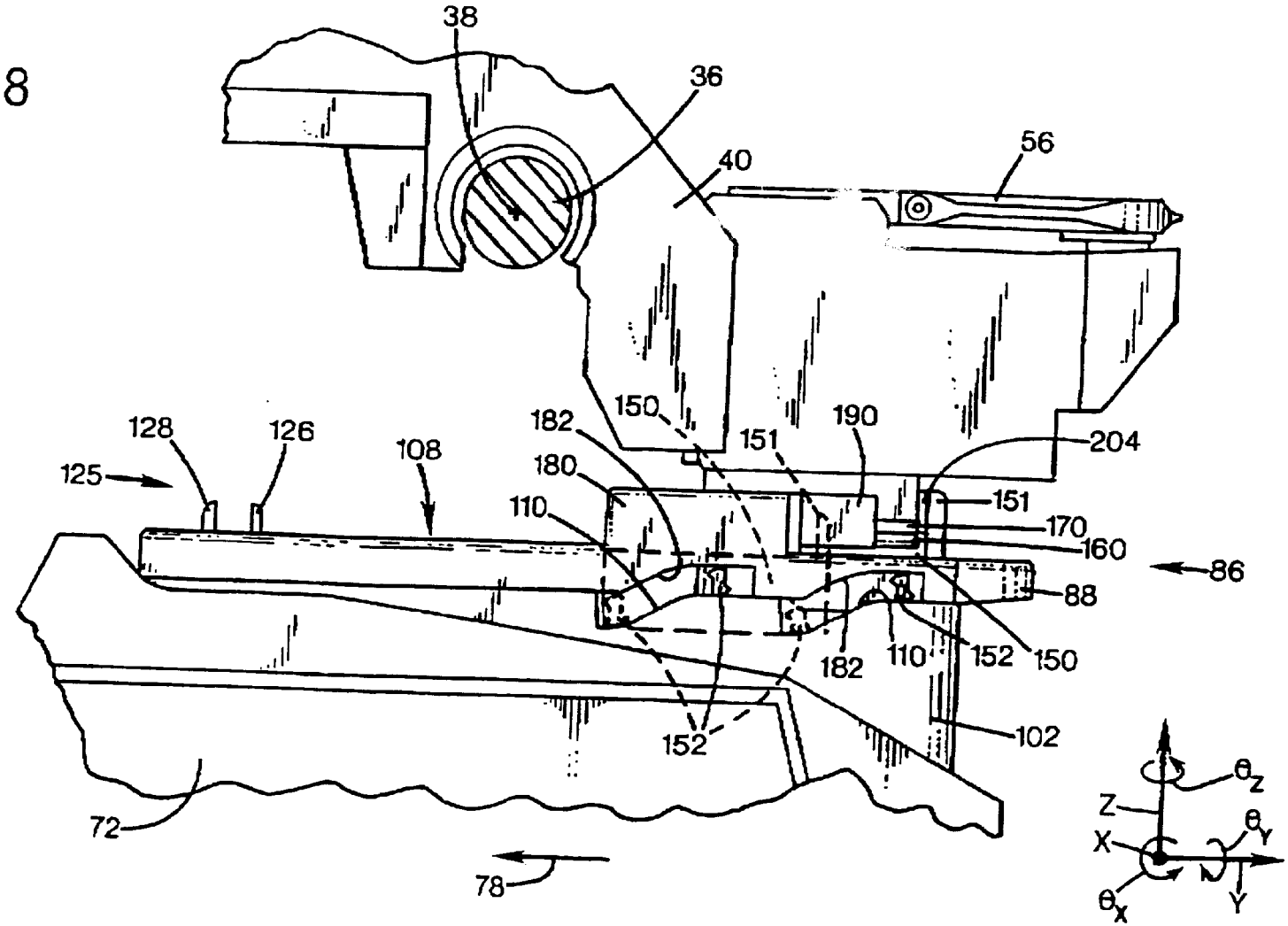
FIG. 8 is an enlarged side elevational view showing a color printhead cleaner unit of FIG. 1 capping an associated color printhead.

FIG. 8 shows the printhead capping routine, here illustrating the cyan printhead of pen 56 being capped by the cyan cleaning unit 86. Here, the service station pallet 72 has been moved in the rearward direction of arrow 78 until the actuation wall 151 of the cap sled 150 has contacted the forward facing surface of pen 56, at a point where the cam followers 152 are shown in dashed lines between the cam surfaces 110 and 182. Further rearward motion 78 elevates the cap sled 15 as the cam followers 152 move upward between cam surfaces 110 and 182, to read the capped position, shown in solid lines in FIG. 8. Thus, the linear motion of the cleaner unit 86 is translated into vertical motion as the cap sled is elevated by the cam followers 152 traveling upwardly along cap ramps 110, 182. Use of the cam surfaces 110, 182 and cam followers 152 eliminates the need for the axis service station actuation because capping is achieved through pure linear motion of pallet 72, without requiring rotation or combinations of rotational and translating motion to achieve capping. Thus, the replaceable service station unit 70 requires only one motor 74 to achieve all the servicing functions, resulting in higher reliability and cost savings, as well as power savings for the ultimate consumer.

In the replaceable servicing units 80–86, the cap sled 150 rides along the cam surfaces 110, 182 to seal the printhead, as shown between the dashed line and solid line positions of FIG. 8. The cap lip 175 moves vertically upward and pushes against the orifice plate of the printhead as the cap sled 150 progresses up the cam surface. The rearward facing surface of the cap sled activation wall 151 has a pair of vertical alignment ribs 204, seen in top view in FIG. 6. In this system, the replaceable cleaning units 80–86 align the sled 150 directly to the printhead in the Y axis and with respect to the theta-z (θ-Z) rotation. The gimbaling action provided by the cap spring 155, and the free floating nature of the cap retainer 160 with respect to sled 150, allows the cap lip and retainer to tilt and gimbal to align the cap to the printhead in the Z axis and with respect to rotation in the theta-x (θ-x) and theta-y (θ-y) directions. Thus, in one embodiment the capping system of the replaceable cleaning units 80–86 allows for closed loop alignment between the cap and the pen, so the cap can be positioned very accurately against the orifice plate. This self alignment routine achieved by the cleaning units 80–86 results in a small tolerance stack, so there is no need to cap encapsulant beads, resulting in the reliable seal at a low capping force. Regarding alignment in the X direction, the cap lips 175 are wide enough to enable open loop alignment between the cap and the printhead in the X direction that is, there is adequate room along the racetrack 206 between each nozzle array and the edge of the printhead to allow some minor misalignment, without endangering sealing over the nozzles, and without increasing the overall width of the printing unit.

Venting is an important aspect of the capping process to prevent forcing air into the printhead nozzles and inadvertently causing nozzle depriming. The cap vents are small air passages that relieve pressure from within a printhead sealing chamber defined between the cap base portion 172, the lip member 175, and the printhead orifice plate. The cap vents 176 prevent the nozzles from being subjected to a positive pressure air pulse as the cap seal lip 175 is compressed during capping, as well as during environmental changes. The capping system of the replaceable cleaning units 80–86 uses a redundant cap vent system, having a pair of vent holes 176 which connect the sealing chamber to the retainer labyrinth path surface 168, which defines passageways leading from the vent holes 176 to atmosphere. The labyrinth vent channels or grooves defined by surface 168 of the cap retainer 160 are sized to prevent pressure differentials from forming during capping actuation, while still creating a resistive path to vapor diffusion when the printhead is sealed. Besides the use of channels or grooves on the labyrinth surface 168, elevated beads may also be used to define these vent paths. The exact sizing and orientation of the labyrinth vent path in the cap retainer will vary depending upon the size of the sealing chamber, the number of printhead nozzles, chemical properties of the inks, and the desired venting versus vapor diffusion characteristic selected for the particular inkjet printhead and printing mechanism.

Aerogel Foam Absorber

As described above for the color cleaner units 82–86, the spittoon 108 is filled with an ink absorber, a porous aerogel foam 124 having a large surface area, a low density, and a rigid, stable outer shape and a rigid, stable inner network. The aerogel foam 124 receives ink spit from the color printheads 62–66, and then holds this ink while the volatiles or liquid components evaporate, leaving the solid components of the ink trapped within the networked chambers of the aerogel material.

The aerogel foam 124 is an open pore, reticulated structure of interconnecting cellular chambers. The walls of the chambers are substantially continuous and non-porous. The volume of the solid areas relative to the overall foam outer dimensional volume provides an overall density at less than about 30% theoretical density resulting in a high void volume. In particular, the aerogel foam is very light having a density of approximately 3 times that of air (i.e., approximately 0.003 g/cm$^3$) the aerogel foam has a high surface area of 600–1000 m$^2$/g, along with good heat resistance and insulation properties. Preferably, the aerogel foam has a density less than 0.01 g/cm$^3$, a surface area of at least 500 m$^2$/g, and is less than 10% solid by volume, leaving approximately 90% by volume available for absorbing waste ink. One skilled in the art will appreciate that the thickness, density and porosity of the aerogel may vary according to the implementation employed.

The aerogel foam 124 is made by combining reacting fluids and solids to form a gel. The materials typically include organic polymers, silicon and a metal containing species (e.g., a metal oxide). In some embodiments the process includes steps for adjusting the pH of the system at each stage leading to the gel to control: the rate of gelation, the solid-gelatin morphology, the solubility of the mixture, the configuration of the reticular network, and the metal ion coordinating capability of the polymer. The resulting gel is a low density network of solids containing the solvents and the resulting liquid reaction products. To remove the solvent and liquid reaction products without destroying or altering the solid network, the gel undergoes a supercritical extraction process. For example, the gel is placed in a vessel and the temperature and pressure are raised above the critical point of the contained solvent and liquid reaction products. This operation vaporizes the liquids. In some embodiments the liquid is replaced in part with an alcohol. The alcohol and remaining liquids then are removed by the supercritical extraction process. The pressure is released leaving the solid reticular network as the monolithic aerogel foam.

Figure 9:
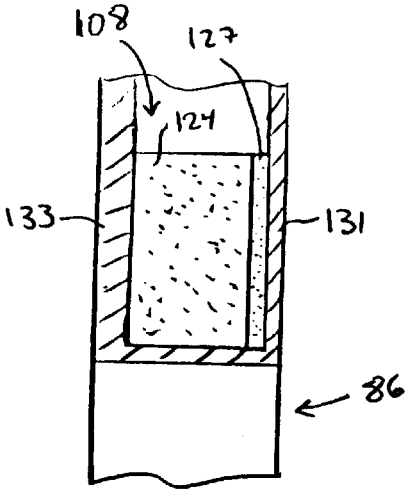
FIG. 9 is a partial planar view of an inkjet cleaner unit.

The aerogel material has been found to be friable, being readily broken into small pieces. Preferably, the aerogel foam retains its monolithic structure during use. Referring to FIG. 9, in one embodiment, an optional shock absorbing material 127 is positioned between the aerogel foam 124 and at least one wall of the spittoon 108. In other embodiments the shock absorbing material is omitted. In still other embodiments the shock absorbing material 127 is included along other or all outer walls of the foam 124 which contact the spittoon 108. The foam 124 resides between opposing walls 131 and 133. In the illustrated embodiment, the shock absorbing material 127 is positioned along wall 131. Referring to FIG. 6, the shock absorption material 127 is hidden from view underlying the housing of the cleaning unit 86. By including the shock absorbing material 127 along wall 131, inadvertent jarring forces having a component perpendicular to the walls 131, 133 are absorbed, at least in part by material 127. The shock absorber 127 is formed by a resilient material such as a nylon sponge or an elastomeric rubber. One skilled in the art will appreciate that many other materials also may be used to embody the shock absorber 127.

Figure 10:
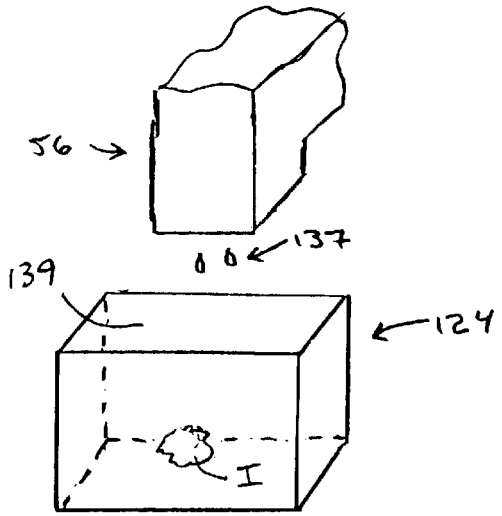
FIG. 10 is a perspective view of ink accumulating in the aerogel foam of FIG. 9.

During operation the aerogel foam 124 quickly absorbs spitted ink 137 to the inner sections of the reticular network as shown in FIG. 10. By the time the ink dries the ink I has been absorbed into the foam 124, allowing newly spitted ink 137 to land on "clean" foam material at surface 139. As a result of this absorption capability, ink is absorbed into the foam during its useful life without building up a mound of ink residue. Due to the relatively high void volume (e.g., approximately 90% in some embodiments) and the rapid absorption, the useful life of the aerogel foam 124 is significantly improved over prior sponge foam materials.

The aerogel foam has a fixed reticular structure which maintains its shape as ink is absorbed. Specifically, the continuous solid walls, formed in part by the metal atoms, maintain their position even as ink is absorbed, flowing through the pores and filling the reticular chambers. As a result, the outer boundary of the aerogel foam 124 maintains its position. This is in contrast to prior sponge-foams which would partially collapse as the contact surface became wetted with ink. Maintaining the position of the contact surface and the shape of the foam is desirable because the distance between the foam and the printhead substantially stays at a fixed distance over the life of the foam 124 to trap floating ink aerosol satellites with the same efficiency over the life of the spittoon. This is advantageous over the prior sponge foam where the distance would increase. In such prior system the increased distance corresponds to an increase in the ink aerosol escaping into the printing system. The aerogel foam spittoon system does not suffer such a corresponding increase in escaping aerosol.

Service Station Operation

Figure 11:
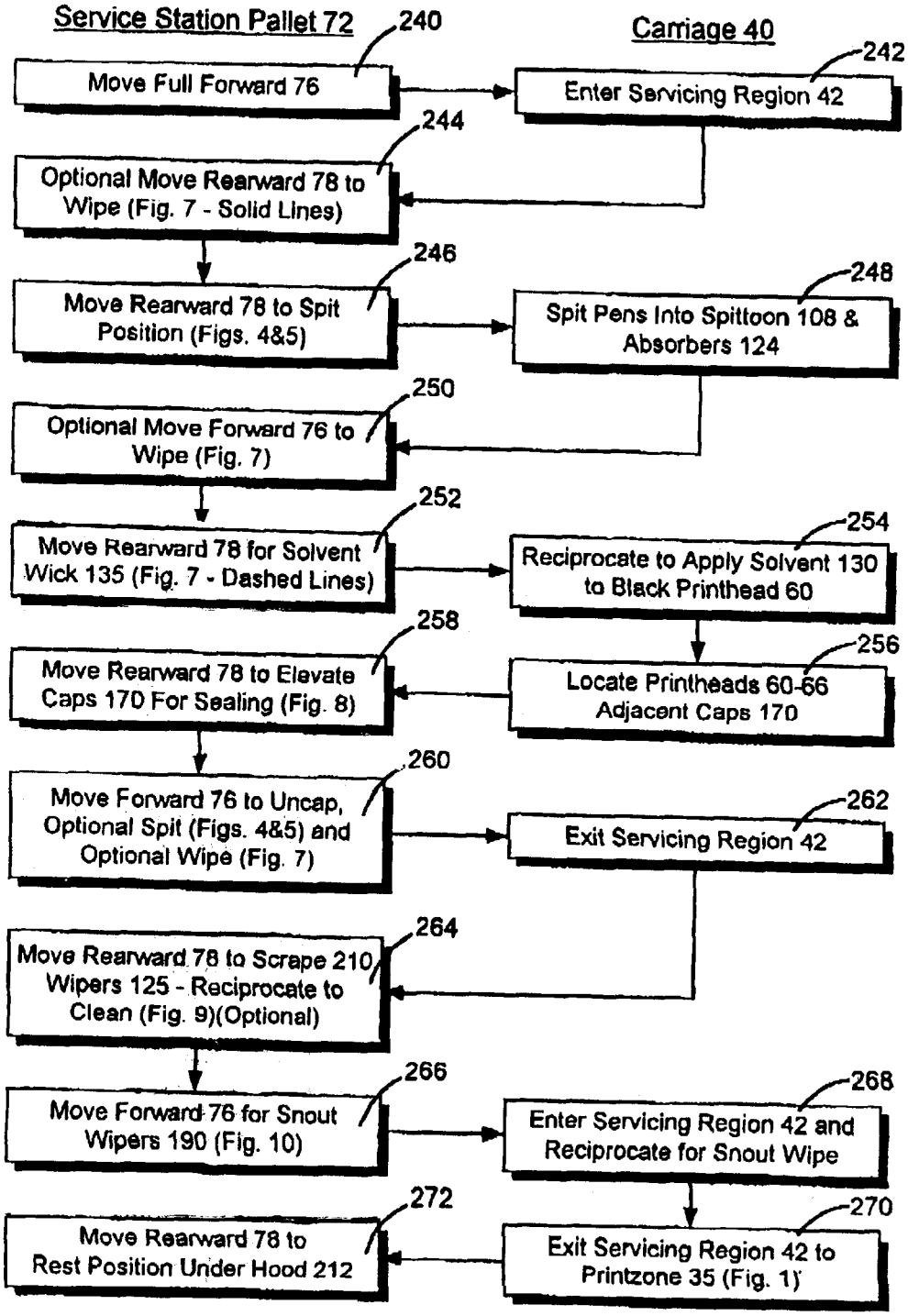
FIG. 11 is a flow chart illustrating one method of servicing printheads using the service station system of FIG. 1.

FIG. 11 is a flow diagram illustrating one manner of operating the service station 70 to service the printheads 60–66 installed in carriage 40. In the flow diagram of FIG. 11, the blocks in the left column all refer to motion the service station pallet 72, while the blocks in the right column all refer to motion of the printhead carriage 40 along the scanning axis 38. Motion of both the service station pallet 72 and the carriage 40 are in response to control signals received from the plotter controller 30. Here, the servicing routine begins following completion of a print job, with the carriage 40 being located in the printzone 35. In a first step 240, the service station pallet 72 is moved in direction 76 to a full forward position, indicated in FIG. 11 as "forward 76," whereas rearward motion in FIG. 11 is indicated as "rearward 78," both referring to arrows 76 and 78 in the drawing figures. The first step 240 is followed by step 242 where carriage 40 enters the servicing region 42.

Once in the servicing region 42, the service station pallet 72 may perform the optional step 244 of moving rearward 78 to wipe the printheads, as shown solid line in FIG. 7. The references to wiping in the flow chart of FIG. 11 just refer to FIG. 7 although it is implied that wiping is shown in solid lines in FIG. 7 from step 244. Following the optional step 244, or if not performed then following step 242, is another step 246 where the service station pallet 72 is moved in the rearward direction 78 to a spit position, as shown in FIGS. 4 and 5 for the black and color printheads, respectively. In step 248, it is assumed that the carriage 40 has positioned the printheads 60–66 over the respective spittoon 108 and aerogel foams 124, so the pens then spit black ink 196 and color ink 198 as shown in FIGS. 4 and 5 into the aerogel foams 124 (also referred to as absorbers), respectively.

Following the spitting step, the service station pallet 72 may take the optional step 250 of moving in the forward direction 76 to wipe the printheads clean of any ink residue, as shown in solid lines in FIG. 7. Following this optional wiping step, the service station pallet 72 then moves in the rearward direction 78 in step 252, until the solvent wick 135 is in the dashed line position of FIG. 7. In this position, with the wick 135 pressing against the black printhead 60, step 254 is performed where the carriage 40 may reciprocate the black printhead 60 gently back and fourth along the scan axis 38 to wick additional solvent 130 from applicator 135, for application on the leading edge 200 of the printhead.

Following the solvent application step 254, the wiping step 250 may optionally be repeated. After this, the carriage 40 then locates the printheads 60–66 in step 256 adjacent the caps 170, where the sled actuator 150 and cam followers 152 are shown in dashed lines in FIG. 8. Following step 256, the service station pallet 72 then moves in the rearward direction 78 in step 258 to elevate the caps 170 for sealing, as shown by the transition of the cap sled from the dashed line position in FIG. 8 to the solid line position. Following the sealing or capping step 258, to ready the printheads 60–66 for printing, step 260 is performed, where the service station pallet 72 moves in the forward direction 76 to uncap the printheads. As a portion of this uncapping step 260, optionally the printheads may be spit as described above with respect to the spitting step 248, as shown in FIGS. 4 and 5, and this spitting may be followed by an optional wiping step such as steps 244, 250, as shown in solid lines in FIG. 7.

Following the uncapping step 260, the carriage 40 may momentarily exit the servicing region 242 in step 262, and enter the printzone 35, allowing the pallet 72 to move rearward in step 264. Step 264 is a scraping step, where the pallet 72 moves the printhead wiper assemblies 125 so the scraper 210 can clean the wipers 125 by reciprocating the service station pallet in the forward and backward directions 76, 78. The scraping step 264 is an optional step if ink solvent is applied by applicators 135 to all of the printheads 60–66 using the gravity drip method to clean the wipers, as illustrated in FIG. 4. In a snout wiping step 266, the service station pallet 72 moves in the forward direction 76 to position the snout wipers 190. Following the snout positioning step 266, the carriage 40 then re-enters the servicing region 42 in step 268 and reciprocates back and forth along the scanning axis 38 for a snout wiping step. Following the snout wiping step 268, is an exiting step 270, where the carriage 40 again exits the servicing region 42 to enter the printzone 35, as shown in FIG. 1 to perform a print job. Following the exiting step 270, in step 272 the service station pallet 72 is moved in the rearward direction 78 to a rest position underneath the stationary service station hood 212, which concludes the servicing routine.

Conclusion

The aerogel foam is that spitted ink is absorbed rapidly into inner sections of the foam. As a result, newly spitted ink is more likely to land on a clean foam area. Building up a mound of dried ink above the foam surface is less likely.

Furthermore, rather than collapsing, the aerogel foam maintains its original outer shape as ink is absorbed. As a result, the original foam to nozzle distance is maintained over the life of the spittoon. This functionality is in contrast to earlier sponge-like absorbers where an increase in foam to nozzle distance corresponded to an increase in inkjet aerosol (i.e., small minute ink particles which become detached from the main ink droplet and float on air currents through the system). By maintaining the original foam to nozzle distance, the increased aerosol corresponding to a collapsing foam is avoided using the aerogel foam absorber 124.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A spittoon system for receiving ink residue spit from an inkjet printhead in an inkjet printing mechanism, comprising:

a storage container defining a chamber; and an aerogel foam within the chamber for absorbing the received ink residue.

2. A spittoon system according to claim 1, in which the foam has a first height which is maintained as said ink residue accumulates within the foam.

3. A spittoon system according to claim 1, in which the aerogel foam comprises a porous network of non-compressible material, the non-compressible material comprising a metal.

4. A spittoon system according to claim 1, in which the foam comprises a porous, reticular network having interconnecting chambers defined by continuous, rigid non-porous walls, the walls comprising solid material, the solid material comprising a metal, the foam being friable, and the system further comprising:

a shock absorber located between the foam and the storage container over at least a portion of the foam, the shock absorber for absorbing a jarring force against the spittoon system in an effort to maintain the foam as a monolithic structure.

5. A spittoon system according to claim 1, in which said aerogel foam is less than 10% solid by volume prior to receiving any ink, wherein the received ink residue is absorbed into a remaining volume of said aerogel foam.

6. A spittoon system according to claim 1, in which the aerogel foam has a density less than 0.01 g/cm3, and a surface area of at least 500 m2/g.

7. An inkjet printing mechanism, comprising:

an inkjet printhead;

a carriage that carries the printhead through a printzone for printing and to a servicing region for printhead servicing; and a spittoon system located in the servicing region to receive ink residue spit from the printhead, with the spittoon system comprising: a storage container defining a chamber; and an aerogel foam within the chamber for absorbing the received ink residue.

8. An inkjet printing mechanism according to claim 7, in which the foam has a first height which is maintained as said ink residue accumulates within the foam.

9. An inkjet printing mechanism according to claim 7, in which the aerogel foam comprises a porous network of solid material, the solid material comprising a metal.

10. An inkjet printing mechanism according to claim 7, in which the foam comprises a porous, reticular network having interconnecting chambers defined by continuous, solid non-porous walls, the walls comprising solid material, the solid material comprising a metal, the foam being friable, and the system further comprising:

a shock absorber located between the foam and the storage container over at least a portion of the foam, the shock absorber for absorbing a jarring force against the spittoon system in an effort to maintain the foam as a monolithic structure.

11. An inkjet printing mechanism according to claim 7, in which said aerogel foam is less than 10% solid by volume prior to receiving any ink, wherein the received ink residue is absorbed into a remaining volume of said aerogel foam.

12. An inkjet printing mechanism according to claim 7, in which the aerogel foam has a density less than 0.01 g/cm3, and a high surface area of at least 500 m2/g.

13. A method of purging ink residue from an inkjet printhead in an inkjet printing mechanism, comprising:

moving the printhead to a servicing region for printhead servicing;

spitting ink residue from the printhead while in the servicing region; and absorbing the ink residue spit into an aerogel foam.

14. A method according to claim 13, in which the aerogel foam has a first height while empty of ink residue, and further comprising:

maintaining the foam at said first height as said ink residue accumulates within the foam.

15. A method according to claim 13, in which the aerogel foam comprises a porous network-of solid material, the solid material comprising a metal, and further comprising:

maintaining the shape of the foam with the solid material as said ink residue accumulates within the foam.

16. A method according to claim 13, in which the aerogel foam comprises less than 10% solid by volume prior to receiving any ink, said absorbing comprising absorbing the received ink residue into a remaining volume of said aerogel foam.

17. A spittoon foam prepared by a process comprising:

combining reacting fluids and solvents to form a network of solids containing the solvents and a liquid reaction product of the combined reacting fluids;

and removing the solvents without destroying the network of solids, the remaining network being an aerogel foam, the spittoon foam comprising the aerogel foam.

18. A spittoon foam according to claim 17, in which said removing comprises removing the solvent without destroying the network of solids, the remaining network being not more than 10% solid by volume.

19. A spittoon foam according to claim in which said combining comprises combining the reacting fluids and solvents in which the reacting fluids comprise a metal source and an organic polymer.

20. A spittoon foam according to claim 17, in which said removing comprises removing the solvent without destroying the network of solids, the remaining network having a density less than 0.01 g/cm3, and a surface area of at least 500 m2/g.

21. A method of purging ink residue from an inkjet printhead in an inkjet printing mechanism, comprising the steps of:

carrying the printhead to a servicing region for printhead servicing;

spitting ink residue from the printhead while in the servicing region; and absorbing the ink residue spit into an aerogel foam.

22. A method according to claim 21, in which the aerogel foam comprises a porous network of solid material, the solid material comprising a metal, and further comprising the step of:

maintaining the shape of the foam with the solid material as said ink residue accumulates within the foam.

23. A method according to claim 21, in which the aerogel foam comprises less than 10% solid by volume prior to receiving any ink, said step of absorbing comprising absorbing the received ink residue into a remaining volume of said aerogel foam.

24. An apparatus for purging ink residue from an inkjet printhead, comprising:

means for carrying the printhead to a servicing region for printhead servicing;

means for spitting ink residue from the printhead while in the servicing region; and means for absorbing the ink residue spit into an aerogel foam.

25. An apparatus according to claim 24, in which the aerogel foam comprises a porous network of solid material, the solid material comprising a metal, and further comprising:

means for maintaining the shape of the foam with the solid material as said ink residue accumulates within the foam.

26. An apparatus according to claim 24, in which the aerogel foam comprises less than 10% solid by volume prior to receiving any ink, said absorbing means comprising means for absorbing the received ink residue into a remaining volume of said aerogel foam.

* * * * *